US006604253B2

(12) United States Patent
Babbini

(10) Patent No.: US 6,604,253 B2
(45) Date of Patent: Aug. 12, 2003

(54) NECK SUPPORT AND ANATOMICAL MATTRESS INCLUDING SUCH A NECK SUPPORT

(76) Inventor: Giuseppe Babbini, 20125 Milano (Italy), Viale Monza, 87 (IT)

( * ) Notice: Subject to any disclaimer, the term of this patent is extended or adjusted under 35 U.S.C. 154(b) by 13 days.

(21) Appl. No.: 09/801,592

(22) Filed: Mar. 8, 2001

(65) Prior Publication Data

US 2001/0034909 A1 Nov. 1, 2001

Related U.S. Application Data

(63) Continuation-in-part of application No. PCT/IT99/00285, filed on Sep. 8, 1999, now abandoned.

(30) Foreign Application Priority Data

Sep. 8, 1998 (IT) ..... TO98A 000755

(51) Int. Cl.[7] ..... A47C 20/04; A47C 20/00
(52) U.S. Cl. ..... 5/733; 5/725
(58) Field of Search ..... 5/733, 725, 638, 5/622

(56) References Cited

U.S. PATENT DOCUMENTS 3,608,103 A * 9/1971 Seld ..... 5/622
3,808,615 A * 5/1974 Geary ..... 5/638
3,828,377 A 8/1974 Fary, Sr.
4,584,730 A 4/1986 Rajan
5,337,429 A 8/1994 Tucker ..... 5/643
5,652,981 A 8/1997 Singer-Leyton et al. ..... 5/631
6,151,734 A * 11/2000 Lawrie ..... 5/638

FOREIGN PATENT DOCUMENTS

DE 4227472 1/1993 ..... A47C/16/00

* cited by examiner

*Primary Examiner*—Alexander Grosz
(74) *Attorney, Agent, or Firm*—Pennie & Edmonds LLP

(57) ABSTRACT

The present invention relates to a mattress and neck support assembly. The mattress has a supporting surface and a head end. The neck support is fittable to the head end, and has a rigid surface, a cavity, which is defined partially by said rigid surface and is located beneath the rigid surface, and supporting means for supporting the rigid surface; the rigid surface supporting the head of a user lying on said mattress. According to the present invention, the mattress has a recess formed at the head end of the mattress. The supporting means, in use, locks the rigid surface in a work position in which the rigid surface allows the cavity to receive, through the recess, at least one upper limb of a user, the user lying on the supporting surface of mattress in a prone position or on one side.

20 Claims, 2 Drawing Sheets

NECK SUPPORT AND ANATOMICAL MATTRESS INCLUDING SUCH A NECK SUPPORT

CROSS REFERENCE

This is a continuation-in-part of International Application PCT/IT99/00285, with an international filing date of Sep. 8, 1999, now abandoned.

TECHNICAL FIELD

The present invention relates to a neck support. In particular, the present invention relates to a neck support for improving sleep in a prone position. The present invention further relates to a mattress including such a neck support.

BACKGROUND ART

As is known, ordinary mattresses comprise a substantially flat surface for supporting the user's body.

The supporting surface is flexible and therefore only adapts to the physical characteristics of the user according to the pressure exerted on each part of the surface.

And to achieve a sleeping position such as to rest the user's neck muscles, pillows are ordinarily used, which are simply placed on the supporting surface of the mattress.

All the above factors result in several drawbacks.

Foremost of these is the tendency of the user, as a result of normal body movement during sleep, to move towards, and so press the pillow against, the headboard.

As a result, the pillow increases in height and so supports the user's head in an excessively high position, causing fatigue and stiffness of the neck muscles.

Further problems arise when the user, during sleep, assumes a prone position or a position lying on one side so that one arm (or both) is bent beneath the body or stretched out beneath the head, and large part of the body weighs on one shoulder or on the arms.

If prolonged, the above position may result in pains in the joints, or may seriously impair blood circulation in the upper limbs, thus resulting in numbing of the upper limbs and a general feeling of discomfort.

The user is therefore awakened frequently, and the quality of the user's sleep seriously impaired, by painful stimuli from the neck or upper limbs.

U.S. Pat. Nos. 5,652,981 and 3,828,377 disclose neck supports for supporting the a user's neck while laying face down.

DISCLOSURE OF INVENTION

It is an object of the present invention to provide a mattress and a neck support assembly designed to eliminate the aforementioned drawbacks, and which in particular enables the user, during sleep, to maintain a prone position or a position lying on one side.

It is a further object of the present invention to provide an anatomical mattress featuring a neck support, and which cooperates with the neck support to enable the user to assume a correct, comfortable sleeping position, in particular a prone position or a position lying on one side.

It is a further object of the present invention to achieve the above in a straightforward, low-cost manner.

The present invention relates to a mattress and a neck support assembly. The mattress comprises a supporting surface and a head end. The neck support is fittable to the head end and comprises a rigid surface, a cavity defined partially by the rigid surface and located beneath the rigid surface, and a supporting means for supporting the rigid surface. The rigid surface supports the head of a user lying on the mattress. According to the present invention, the mattress comprises a recess formed at the head end of the mattress. The supporting means, in use, locks the rigid surface in a work position where the rigid surface allows the cavity to receive, through the recess, at least one upper limb of a user when the user is lying on the supporting surface of the mattress in a prone position or on one side.

The present invention also relates to an anatomical mattress. The anatomical mattress comprises a supporting surface for receiving the body of a user, a head end for accommodating the upper portion of the body of the user, a first recess formed close to the head end, a second recess formed at the head end and communicating with the first recess, and a neck support. The neck support comprises a rigid surface covering the second recess and a supporting means for supporting the rigid surface and locking the rigid surface in a work position. The first recess has an opening coplanar with the supporting surface. In the work position, the rigid surface defines, with a bottom wall of the second recess, a cavity for receiving, through the first recess, at least one upper limb of the user lying on the mattress in a prone position or on one side.

Some of the advantages of the present invention will be clear from the foregoing description. In particular, both the height and tilt of the neck support may be adjusted to best suit the physical characteristics and size of the user; and, being fixed with respect to the mattress, the support provided for the user's head by the neck support is unaffected by any involuntary movement of the user during sleep.

A further advantage lies in the anatomical mattress being so shaped as to reduce the load on the shoulders and arms of the user when lying in a prone position or on one side.

The weight of the trunk and head is better distributed, thus preventing pains in the joints and numbing of the upper limbs due to impaired blood circulation.

The user therefore assumes a more comfortable sleeping position, which no longer results in frequent awakening of the user or discomfort during sleep.

BRIEF DESCRIPTION OF THE DRAWINGS

A number of non-limiting embodiments of the present invention will be described by way of example with reference to the accompanying drawings, in which.

BEST MODE FOR CARRYING OUT THE INVENTION

Figure 1:
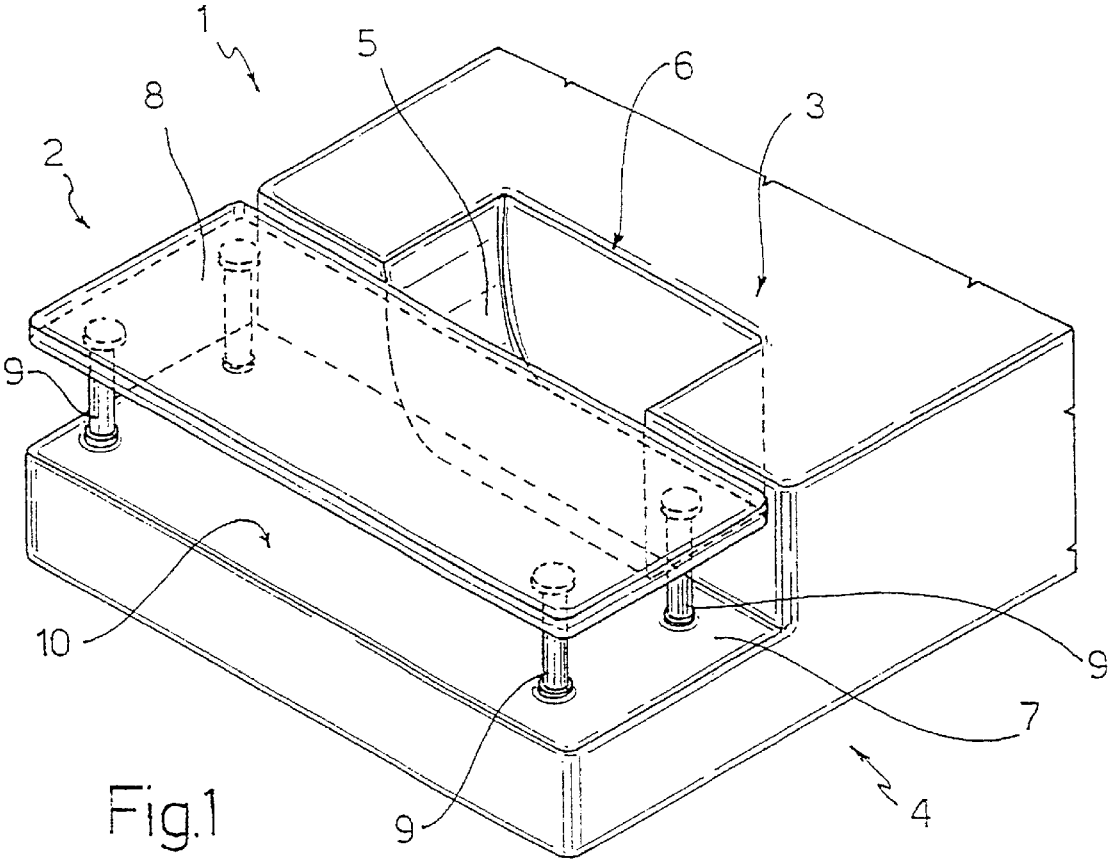
FIG. 1 shows a view in perspective of an anatomical mattress with a neck support, in accordance with the teachings of the present invention.
Figure 2:
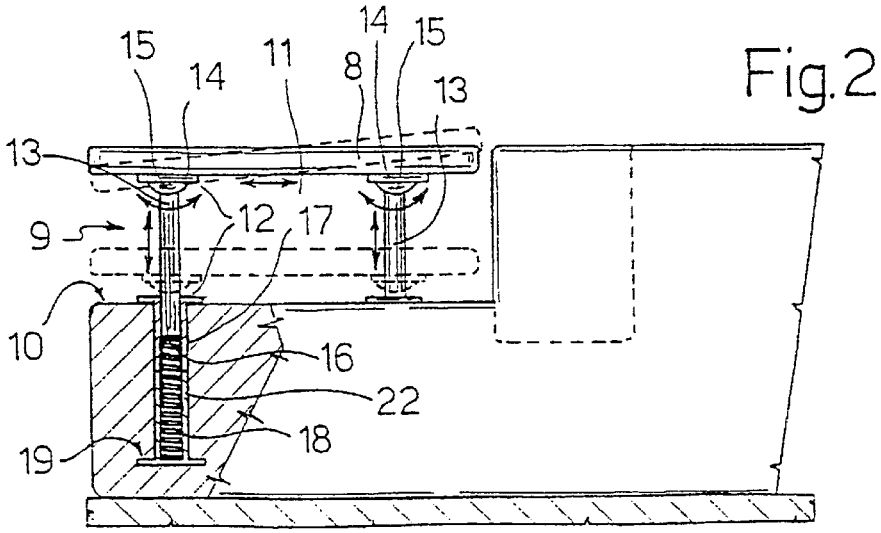
FIG. 2 shows a partially sectioned side view of the FIG. 1 mattress and support.

With reference to FIGS. 1 and 2, numeral reference 1 indicates an anatomical mattress fittable with a neck support 2.

In a first embodiment of the invention, mattress 1 can comprise a supporting surface 3 for supporting the body of a user; a head end 4 for receiving the upper portion of the user's body; and a first recess 5 formed close to head end 4 and having an opening 6, coplanar with supporting surface 3, for receiving at least one upper limb of the user.

Anatomical mattress 1 can also comprise a substantially step-shaped second recess 7 formed at head end 4 and communicating with first recess 5.

Neck support 2 can comprise a rigid surface 8 for supporting the head of a user lying on mattress 1 and supporting means 9 for supporting rigid surface 8.

Neck support 2 can be so located as to cover head end 4 of mattress 1.

Supporting means 9 is capable of, in use, locking rigid surface 8 in a work position in which the rigid surface defines, with a bottom wall 10 of second recess 7, a cavity 11 for receiving, through recess 5 and opening 6, at least one upper limb of a user lying on supporting surface 3 of mattress 1 in a prone position or on one side.

Supporting means 9 can comprise adjusting means 12 for adjusting the height of rigid surface 8 with respect to supporting surface 3, for adjusting rigid surface 8 longitudinally with respect to mattress 1 and/or for adjusting the tilt of rigid surface 8.

In an embodiment, supporting means 9 can comprise a number of supporting feet 13. Each foot 13 can be adjustable independently in height and connected to rigid surface 8 by sliding means 14 for adjusting the position of rigid surface 8 longitudinally with respect to mattress 1. Sliding means 14 can conveniently comprise sliding pads or the like. Additionally or alternatively, each foot 13 can be connected to rigid surface 8 by spherical joint means 15 for adjusting the tilt of rigid surface 8.

The bottom end 16 of each supporting foot 13 can be inserted inside a respective sleeve 17, where bottom end 16 cooperates with a respective contrast spring 18 located between a base 19 of the respective sleeve 17 and end 16 of foot 13, and which provides for pushing foot 13 upwards.

Ends 16 can be locked selectively at different heights by means of known click-on locking devices (not described) to fix the height of rigid surface 8.

In the example shown, sleeves 17 are housed in respective seats 22 formed in mattress 1 (as shown in FIGS. 1 and 2).

Figure 3:
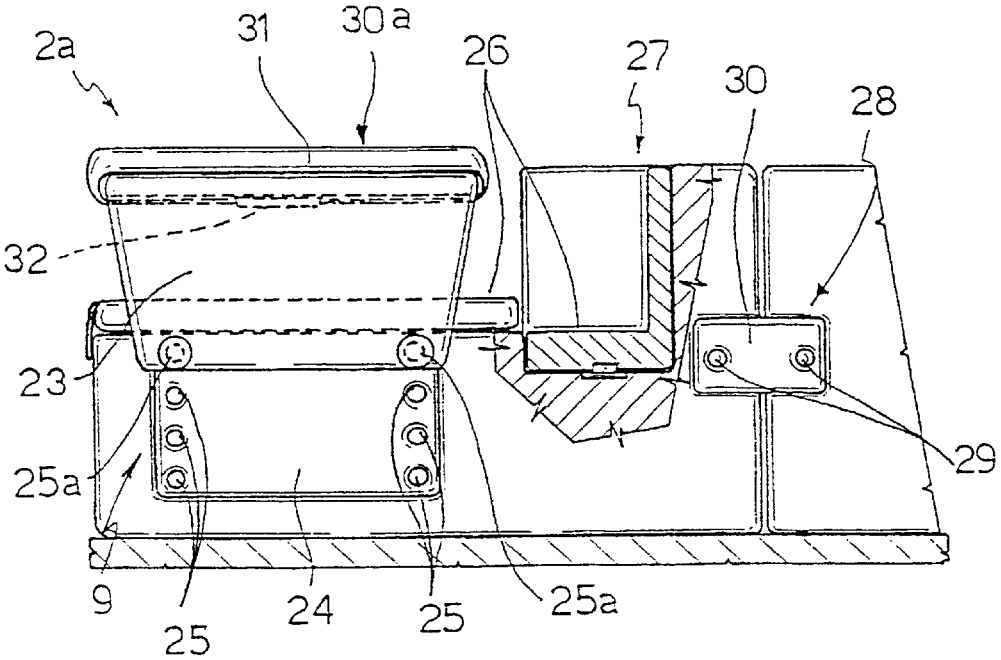
FIG. 3 shows a partially sectioned side view of a second embodiment of an anatomical mattress with a neck support, in accordance with the teachings of the present invention.
Figure 4:
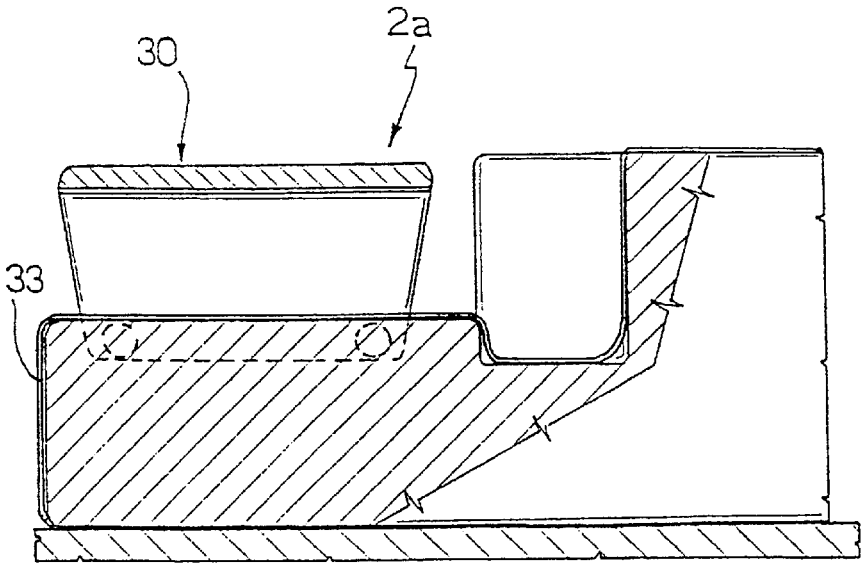
FIG. 4 shows a side view of the FIG. 3 support mattress comprising a sheet.

FIGS. 3 and 4 show a second embodiment of the neck support according to the invention, indicated by numeral reference 2*a*. For the sake of simplicity, in the following description of the second embodiment and other variations, any parts similar to or identical with those already described are indicated using the same reference numbers.

In particular, at opposite ends, rigid surface 8 can have two wings 23 projecting perpendicularly downwards. Wings 23 may be fixed selectively in different positions to respective supports 24 on the mattress, such as by means of a number of snap fasteners 25. In one embodiment, snap fasteners 25 can be arranged in at least two parallel columns so that respective fasteners 25*a* on wings 23 may be connected to fasteners 25 in the two columns at the same or different heights to adjust the height and tilt of rigid surface 8. Additionally or alternatively, it is possible to adjust rigid surface 8 longitudinally if more than two columns of fasteners 25 are provided.

In further embodiments not described for the sake of simplicity, supporting means 9—in particular, sleeves 17—of neck support 2 and supports 24 of neck support 2*a* may be carried by a structural portion supporting mattress 1, as opposed to mattress 1 itself.

First recess 5 and second recess 7 can be designed to receive, respectively, a first and a second series of preformed adapter cushions 26 of different thicknesses to adjust the size of and adapt recesses 5 and 7 to the physical characteristics and size of the user.

With reference to FIG. 3, in a further embodiment of the invention, head end 4, comprising first recess 5, second recess 7, and neck support 2 or 2*a*, is defined by a removable anatomical appendix 27 fittable to mattress 1 by means of first fastening means 28.

First fastening means 28 can be conveniently defined by snap fasteners 29 on the ends of a pair of plates or strips 30. In a variation not shown for the sake of simplicity, fastening means 28 may be defined by at least one pair of Velcro type fastener strips.

Whichever the case, in the FIG. 3 variation, mattress 1 is shorter than the standard length, and is made up to standard mattress length by the addition of appendix 27.

In another embodiment, on the upper face 30*a* of rigid surface 8, neck support 2*a* can have removable padding 31 fitted to rigid surface 8 by second fastening means 32. This variation can be applied to embodiment shown in FIGS. 1 and 2.

With reference to FIG. 4, the present invention can also relate to a sheet 33 shaped to conform to supporting surface 3 and to surfaces defining first recess 5 and second recess 7 of mattress 1. Sheet 33 can be mounted onto such surfaces by various methods, such as by mechanical fasteners, Velcro type closures, and adhesion.

The present invention can be used as follows.

When resting on mattress 1, the user's body is stretched out on supporting surface 3, with the user's head supported on neck support 2. Neck support 2 can be adjusted beforehand to the user's physical characteristics and size to provide optimum support.

The user may assume a prone position or a position lying on one side, in which case, one or both arms may be inserted through first recess 5 into cavity 11. The user's arms are thus located beneath the head, the weight of which, however, is supported entirely by neck support 2.

Depending on the position assumed, the weight of the trunk is distributed over the chest and abdomen or along one side, with no weight on the shoulder joints or arms. Prolonged pressure, which may result in pains in the joints or impaired blood circulation, in turn resulting in numbing of the upper limbs, is therefore prevented. As such, any painful stimuli disturbing the user's sleep, by frequently awakening and causing discomfort of the user, are eliminated.

Clearly, changes may be made to anatomical mattress 1 and neck support 2 as described herein without, however, departing from the scope of the present invention. In particular, neck support 2 (or variation 2*a*) may obviously be applied to any traditional mattress. In which case, cavity 11 can be defined between rigid surface 8 and supporting surface 3 of the mattress, which extends over the whole of head end 4 of the mattress.

What is claimed is:

1. A mattress and neck support assembly, the mattress comprising a supporting surface and a head end; the neck support being fittable to said head end and comprising a rigid surface, a cavity defined partially by said rigid surface and located beneath said rigid surface, and a supporting means for supporting said rigid surface; said rigid surface supporting the head of a user lying on said mattress, wherein said mattress comprises a recess formed at said head end of said mattress; and wherein said supporting means, in use, locks said rigid surface in a work position in which the rigid surface allows said cavity to receive, through said recess, at least one upper limb of a user, the user lying on said supporting surface of said mattress in a prone position or on one side;

wherein said head end is defined by a removable anatomical appendix fittable to a remaining portion of said mattress.

2. The mattress and neck support assembly as claimed in claim 1, wherein the supporting means comprises an adjusting means for adjusting the height of said rigid surface with respect to said supporting surface of said mattress, for adjusting said rigid surface longitudinally with respect to said mattress, and for adjusting the tilt of said rigid surface.

3. The mattress and neck support assembly as claimed in claim 2, wherein said mattress is supported by a structural portion, wherein said supporting means is shaped such that it is fittable selectively to said mattress or to said structural portion; said adjusting means being lockable to prevent any movement of said neck support caused by involuntary movement of said user.

4. The mattress and neck support assembly as claimed in claim 1, wherein said mattress is supported by a structural portion, wherein said supporting means is shaped such that it is fittable selectively to said mattress or to said structural portion; said adjusting means being lockable to prevent any movement of said neck support caused by involuntary movement of said user.

5. A mattress and neck support assembly as claimed in claim 1, wherein said neck support has removable padding on an upper face of said rigid surface; said padding being fittable to said upper face of said rigid surface by a second fastening means.

6. An anatomical mattress comprising:

a supporting surface for receiving the body of a user, a head end for accommodating the upper portion of the body of said user, a first recess formed close to said head end, a second recess formed at said head end and communicating with said first recess, and a neck support comprising a rigid surface covering said second recess and a supporting means for supporting said rigid surface and locking the rigid surface in a work position; said first recess having an opening coplanar with said supporting surface;

wherein, in said work position, said rigid surface defines, with a bottom wall of said second recess, a cavity for receiving, through said first recess, at least one upper limb of said user lying on said mattress in a prone position or on one side.

7. The anatomical mattress as claimed in claim 6, wherein said supporting means comprises a number of supporting feet adjustable independently in height and connected to said rigid surface by a sliding means for adjusting the position of said rigid surface longitudinally with respect to said mattress, and by a spherical joint means for adjusting the tilt of said rigid surface.

8. The anatomical mattress as claimed in claim 7, wherein said first and said second recesses respectively receive a first and a second series of preformed adapter cushions to adjust the dimensions of said first and said second recess and to adapt the first and second recess to the physical characteristics of said user.

9. The anatomical mattress as claimed claim 8, wherein said head end is defined by a removable anatomical appendix fittable to a remaining portion of said mattress by a first fastening means; said head end comprising said first and said second recess and said neck support.

10. A mattress and neck support assembly as claimed in claim 8, wherein said neck support has removable padding on an upper face of said rigid surface; said padding being fittable to said upper face of said rigid surface by a second fastening means.

11. The anatomical mattress as claimed in claim 6, wherein said rigid surface has, at opposite ends, a pair of wings projecting perpendicularly downwards; said wings being fastenable selectively to at least one of respective supports and to said mattress by means of a number of snap fasteners arranged in at least two parallel columns to adjust the height and tilt of said rigid surface and to adjust said rigid surface longitudinally with respect to said mattress.

12. The anatomical mattress as claimed in claim 11, wherein said first and said second recesses respectively receive a first and a second series of preformed adapter cushions to adjust the dimensions of said first and said second recess and to adapt the first and second recess to the physical characteristics of said user.

13. The anatomical mattress as claimed claim 12, wherein said head end is defined by a removable anatomical appendix fittable to a remaining portion of said mattress by a first fastening means; said head end comprising said first and said second recess and said neck support.

14. A mattress and neck support assembly as claimed in claim 12, wherein said neck support has removable padding on an upper face of said rigid surface; said padding being fittable to said upper face of said rigid surface by a second fastening means.

15. The anatomical mattress as claimed in claim 6, wherein said first and said second recesses respectively receive a first and a second series of preformed adapter cushions to adjust the dimensions of said first and said second recess and to adapt the first and second recess to the physical characteristics of said user.

16. A mattress and neck support assembly as claimed in claim 15, wherein said neck support has removable padding on an upper face of said rigid surface; said padding being fittable to said upper face of said rigid surface by a second fastening means.

17. The anatomical mattress as claimed claim 6, wherein said head end is defined by a removable anatomical appendix fittable to a remaining portion of said mattress by a first fastening means; said head end comprising said first and said second recess and said neck support.

18. A mattress and neck support assembly as claimed in claim 17, wherein said neck support has removable padding on an upper face of said rigid surface; said padding being fittable to said upper face of said rigid surface by a second fastening means.

19. A sheet to be used with an anatomical mattress as claimed in claim 6, wherein said sheet is preformed as to adhere to said supporting surface and to surfaces defining said first and said second recess of said mattress.

20. A mattress and neck support assembly as claimed in claim 6, wherein said neck support has removable padding on an upper face of said rigid surface; said padding being fittable to said upper face of said rigid surface by a second fastening means.

* * * * *